United States Patent [19]

Sugimoto et al.

[11] Patent Number: 5,057,043

[45] Date of Patent: Oct. 15, 1991

[54] POWER STEERING SYSTEM FOR BOAT

[75] Inventors: Fumikazu Sugimoto, Gifu; Masataka Kase, Kanagawa; Manabu Yamada, Gifu, all of Japan

[73] Assignee: Kayaba Industry Co. Ltd., Japan

[21] Appl. No.: 533,537

[22] Filed: Jun. 5, 1990

[30] Foreign Application Priority Data

Jun. 7, 1989 [JP] Japan ..... 1-144432

[51] Int. Cl.[5] ..... B63H 21/26

[52] U.S. Cl. ..... 440/61; 114/144 R; 114/150; 180/79.1; 440/60

[58] Field of Search ..... 114/144 R, 144 E, 150; 440/60, 61, 58, 59; 180/79.1

[56] References Cited

U.S. PATENT DOCUMENTS

| | | | |
|---|---|---|---|
| 1,747,768 | 2/1930 | Fuller | 180/79.1 |
| 1,948,487 | 2/1934 | Berry | 114/144 R |
| 3,135,095 | 6/1964 | Peterson | 114/150 |
| 3,874,321 | 4/1975 | Smith | 440/60 |
| 4,041,889 | 8/1977 | Blanchard | 440/61 |
| 4,295,833 | 10/1981 | Borst | 440/61 |
| 4,419,084 | 12/1983 | Borst | 114/144 R |
| 4,773,882 | 9/1988 | Rump | 440/61 |
| 4,892,494 | 1/1990 | Ferguson | 440/61 |

FOREIGN PATENT DOCUMENTS

| | | | |
|---|---|---|---|
| 114590 | 5/1989 | Japan | 114/150 |

*Primary Examiner*—Sherman Basinger
*Assistant Examiner*—Thomas J. Brahan
*Attorney, Agent, or Firm*—Steinberg & Raskin

[57] ABSTRACT

A power steering system for a boat which is capable of accurately detecting steering torque of a steering wheel, to thereby generate appropriate assistance force corresponding to the steering torque. Rotation of the steering wheel causes pressure to be produced in one of cylinder chambers of a cylinder mechanism, so that steering torque of the steering wheel may be detected depending upon a difference in pressure between cylinder chambers, to thereby permit a drive motor to generate assistance force corresponding to the detected steering torque.

4 Claims, 3 Drawing Sheets

POWER STEERING SYSTEM FOR BOAT

BACKGROUND OF THE INVENTION

This invention relates to a power steering system for a boat, and more particularly to a power steering system for a boat which is adapted to accurately detect steering torque of a steering wheel to permit a drive motor to generate appropriate assistance force.

A power steering system which has been conventionally used for a boat is generally constructed in such a manner as shown in FIG. 1. More particularly, the conventional power steering system includes a steering wheel 103 mounted at the front portion of a boat 101 which is provided at the rear portion thereof with an outboard motor 105 including an engine 107 and a screw propeller 109. The power steering system also includes a steering arm 111 which is connected to the outboard motor 105 and pivotally mounted on the boat 101 through a shaft 112 in a manner to be pivotally movable about the shaft 112. To the steering arm 111 is connected a lever 113. Between the steering wheel 103 and the lever 113 is arranged a wire 115 in a manner to extend therebetween, which is enclosed in a wire tube 117. On the lever 113 is fixedly mounted a rack 119, which is engaged with a pinion 121. The power steering system further includes a drive motor 123, which is arranged so as to be engaged with the pinion 121 through a speed reducer 125.

Also, the conventional power steering system includes a torque sensor 127 arranged at the portion of the wire 115 adjacent to the outboard motor 107, which is adapted to detect steering torque of the steering wheel 103 to generate a detection signal s127, which is then supplied to a controller 129. The controller 129 then generates a control signal s129 depending upon the so-supplied detection signal s127, which is then supplied to the drive motor 123, resulting in the drive motor 123 generating assistance force which corresponds to the steering torque. Thus, the drive motor 123 generates assistance force depending upon the steering torque of the steering wheel, resulting in desired steering operation. This leads to a significant decrease in steering force.

The outboard motor 107 is provided with a revolving speed sensor 131 for detecting a speed of the boat, a neutral switch 133 and a reverse switch 135, which respectively supply signals s131, s133 and s135 to the controller 129. Also, to the controller 129 is supplied electric power from a power supply or battery 137.

However, in the conventional power steering system constructed as described above, the wire 115 is arranged in the wire tube 117. This causes frictional resistance to occur between the wire 115 and the wire tube 117 when the wire is actuated, which prevents the steering torque from being accurately transmitted to the torque sensor 127.

SUMMARY OF THE INVENTION

The present invention has been made in view of the foregoing disadvantage of the prior art.

Accordingly, it is an object of the present invention to provide a power steering system for a boat which is capable of automatically carrying out desired steering operation.

It is another object of the present invention to provide a power steering system for a boat which is capable of accurately detecting steering torque, to thereby generate assistance force appropriately corresponding to the steering torque.

It is another object of the present invention to provide a power steering system for a boat which is capable of accomplishing the above-described objects with simple construction.

In accordance with the present invention, a power steering system for a boat including an engine pivotally movably mounted on the boat is provided which comprises a steering wheel mounted on the boat, a lever connected to the engine, a rack connected to the lever, a pinion engaged with the rack and a drive motor connected to the pinion.

The power steering system is featured in that it further comprise a cylinder mechanism connected to the lever and including a cylinder, a piston connected to the lever and slidably arranged in the cylinder, and at least one piston rod provided on the piston, the cylinder mechanism being formed with a pair of chambers in a manner to be positioned on both sides of the piston; a pressure oil feed means for discharging pressure oil at a flow rate corresponding to the number of revolutions of the steering wheel; a pair of hydraulic pipings arranged between the pressure oil feed means and the chambers of the cylinder mechanism formed on both sides of the piston; a pressure difference detection means for detecting a difference in pressure between the chambers of the cylinder mechanism to generate a detection signal; and a controller for supplying a control signal to the drive motor depending upon the detection signal from the pressure difference detection means to cause the drive motor to generate assistance force corresponding to steering torque of the steering wheel.

In a preferred embodiment of the present invention, the pressure difference detection means may directly detect a difference in pressure between the chambers of the cylinder mechanism.

Alternatively, the pressure difference detection means may detect the mount of displacement of the piston rod or the mount of strain of the piston rod.

In the power steering system of the present invention constructed as described above, when steering torque is transmitted from the steering wheel to the pressure oil feed means, the pressure oil feed means feeds pressure oil in an amount corresponding to the number of revolutions of the steering wheel to one of the chambers formed on both sides of the piston, during which pressure oil in the other chamber is returned through the corresponding hydraulic piping to the pressure oil feed means. This causes a difference in pressure to be produced between both chambers. The so-produced pressure difference is detected by the pressure difference detection means, which then supplies a detection signal to the controller. Then, the controller supplies a control signal to the drive motor depending upon the detection signal, resulting in the drive motor generating assistance force corresponding to the steering torque.

The assistance force generated from the drive motor causes the lever to be moved through the pinion and rack to pivotally move the engine in an appropriate direction, leading to desired steering operation. Thus, it will be noted that the power steering system of the present invention accurately detects steering torque of the steering force to permits the drive motor to generate assistance force corresponding to the detected steering torque.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
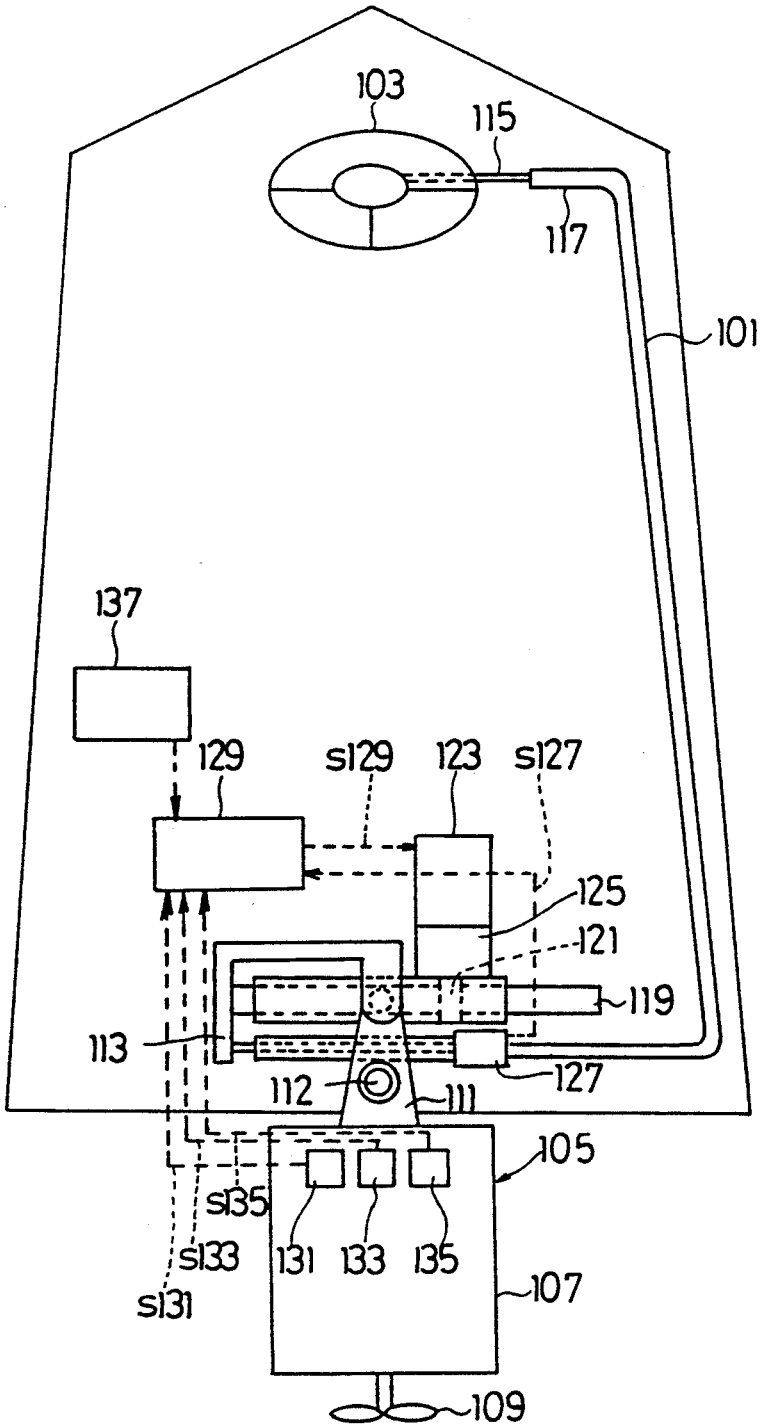
FIG. 1 (PRIOR ART)
FIG. 1 is a schematic plan view showing a conventional power steering system for a boat.

Now, a power steering system for a boat according to the present invention will be described hereinafter with reference to FIGS. 2 to 5, wherein like reference characters designate like or corresponding parts throughout.

Figure 2:
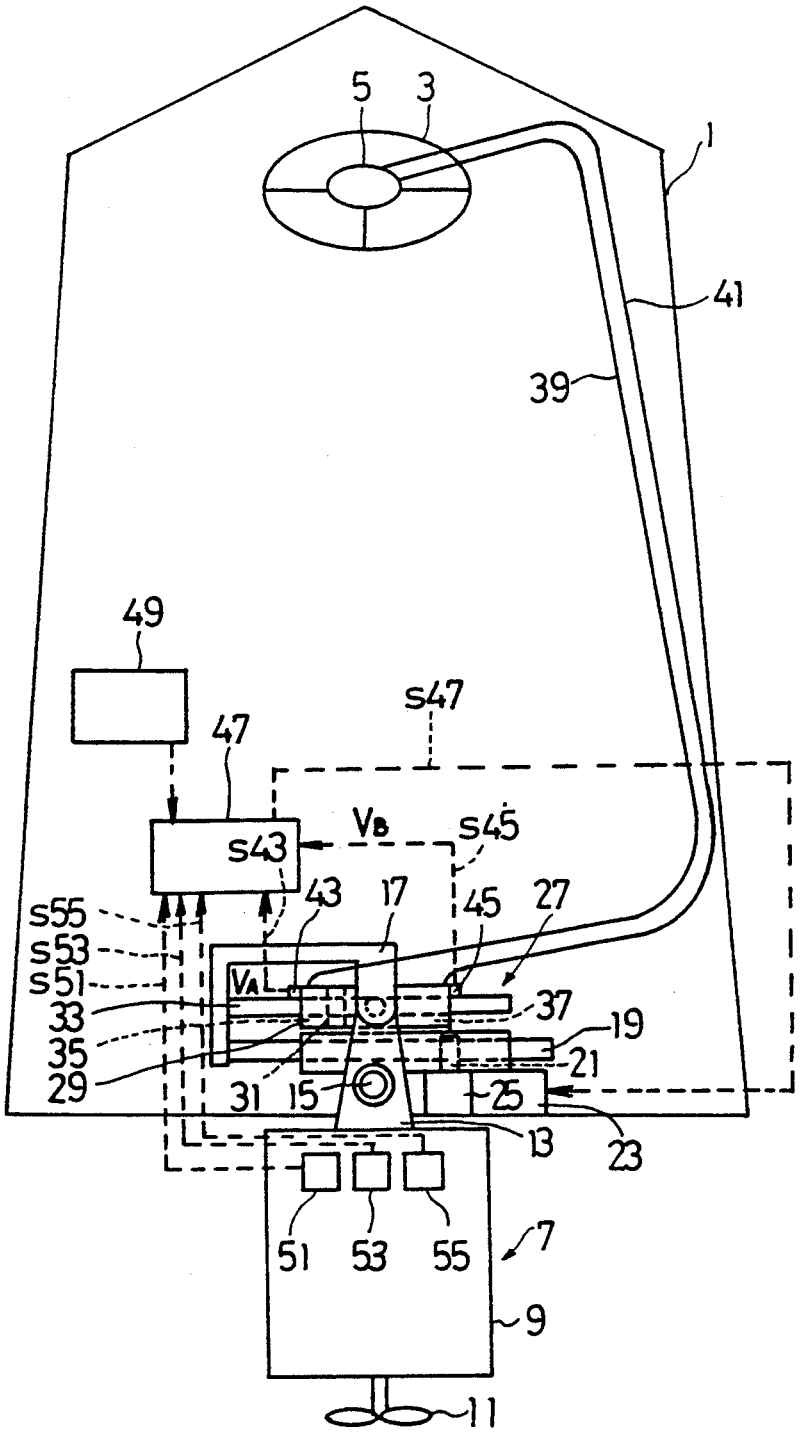
FIG. 2 is a schematic plan view showing a first embodiment of a power steering system for a boat according to the present invention.

FIG. 2 shows an embodiment of a power steering system for a boat according to the present invention. A power steering system of the illustrated embodiment includes a steering wheel 3 mounted at the front portion of a boat 1 and a pressure oil feed means 5 connected to the steering wheel 3. In the illustrated embodiment, the pressure oil feed means 5 may comprise a trochoid pump and a tank and is adapted to discharge pressure oil at a flow rate corresponding to the number of revolutions of the steering wheel 3. On the rear portion of the boat 1 is mounted an outboard motor 7, which comprises an engine 9 and a screw propeller 11.

The power steering system also includes a steering arm 13 connected to the outboard motor 7 and pivotally movably mounted through a shaft 15 on the boat 1 so as to be pivotally movable about the shaft 15. The pivotal movement of the steering arm 13 about the shaft 15 causes the outboard motor 7 to be pivotally moved in the same direction as the steering wheel. To the steering arm 13 is connected a lever 17, to which a rack 19 is then connected. The rack 19 is engaged with a pinion 21, which is then connected through a speed reducer 25 to a drive motor 23.

The power steering system further includes a cylinder mechanism 27 arranged in proximity to the lever 17, which, in the illustrated embodiment, comprises a cylinder 29, a piston 31 slidably arranged in the cylinder 29 and piston rods 33 arranged on both sides of the piston 31. On both sides of the piston 31 are formed cylinder chambers 35 and 37, which communicate through hydraulic pipings 39 and 41 with the pressure oil feed means 5, respectively. At the cylinder chambers 35 and 37 are arranged pressure sensors 43 and 45, respectively, which serve to detect pressure $V_A$ in the cylinder chamber 35 and pressure $V_B$ in the cylinder chamber 37 to generate detection signals s43 and s45, respectively. The so-generated detection signals s43 and s45 are then supplied to a controller 47. The controller 47 is supplied with electric power from a power supply or battery 49. The outboard motor 7 is provided with a revolving speed sensor 51, a neutral switch 53 and a reverse switch 55 which are adapted to supply signals s51, s53 and s55 to the controller 49, respectively.

The controller 47 calculates or detects a difference in pressure ($V_A - V_B$) between the cylinders 43 and 45 depending upon the detection signals s43 and s45 respectively supplied thereto from the pressure sensors 43 and 45. The pressure difference is proportional to the steering torque of the steering wheel 3, so that the detection of the pressure difference may permit the steering torque to be accurately detected. The controller 47 supplies a control signal s47 to the drive motor 23 depending upon the detected pressure difference and the signals s51, s53 and s55 respectively supplied from the revolving speed sensor 51, neutral switch 53 and reverse switch 55, to thereby cause the drive motor 23 to generate assistance force corresponding to the steering torque.

Now, the manner of operation of the power steering system of the illustrated embodiment constructed as described above will be described hereinafter.

First, the steering wheel 3 is rotated in a desired direction, leading to steering torque, which is then transmitted to the pressure oil feed means 5. This causes the pressure oil feed means 5 to be actuated, resulting in pressure oil being fed, for example, to the cylinder chamber 35 through the hydraulic piping 39. Pressure under which the pressure oil is fed to the cylinder chamber 35 is proportional to the steering torque. Pressure oil in the cylinder chamber 37 is returned through the hydraulic piping 41 to the tank of the pressure oil feed means 5.

Pressure $V_A$ in the cylinder chamber 35 and pressure $V_B$ in the cylinder chamber 37 are detected by the pressure sensors 43 and 45, which supply detection signals s43 and s45 to the controller 47, respectively. The controller 47 is also supplied with signals s51, s53 and s55 from the revolving speed sensor 51, neutral switch 53 and reverse switch 55, respectively. The controller 47 calculates or detects a difference in pressure ($V_A - V_B$) between the cylinder chambers 35 and 37 depending upon the detection signals s43 and s45 and supplies a control signal s47 to the drive motor 23 depending upon the signals s51, s53 and s55 as well, so that the drive motor 23 may be rotated by means of a current corresponding to the steering torque. This causes the lever 17 to be slid through the pinion 21 and rack 19, resulting in the steering arm 13 being pivotally moved about the shaft 15. Such pivotal movement of the steering arm 13 causes the outboard motor 7 to be pivotally moved, leading to desired steering.

Thus, the steering torque of the steering wheel 3 causes the drive motor 23 to generate assistance force appropriately corresponding to the steering torque, so that desired steering may be automatically accomplished.

As will be noted from the above, the illustrated embodiment employs a hydraulic system which permits the above-described disadvantages of the prior art due to frictional resistance between the wire and the wire tube to be effectively eliminated, to thereby detect the steering torque with high accuracy. Thus, the illustrated embodiment generates an appropriate amount of assistance force corresponding to the steering torque, to thereby improve a feeling of steering.

Figure 3:
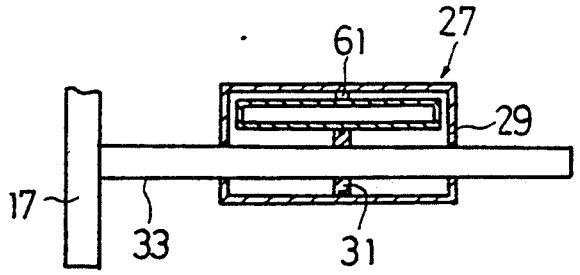
FIG. 3 is a fragmentary schematic sectional view showing a pressure difference detection means in a second embodiment of a power steering system for a boat according to the present invention.

FIG. 3 shows a second embodiment of a power steering system for a boat according to the present invention. In the first embodiment, as described above, the two pressure sensors 43 and 45 are provided in order to detect pressures in the cylinder chambers 35 and 37, respectively. A power steering system of the second embodiment is so constructed that a single pressure sensor 61 is provided to detect a difference in pressure between cylinder chambers 35 and 37. The remaining part of the second embodiment may be constructed in substantially the same manner as the first embodiment described above.

Figure 4:
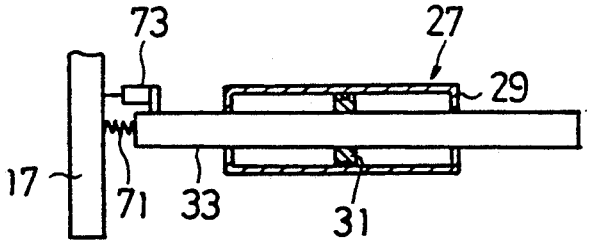
FIG. 4 is a fragmentary schematic sectional view showing a pressure difference detection means in a third embodiment of a power steering system for a boat according to the present invention.

FIG. 4 shows a third embodiment of a power steering system for a boat according to the present invention, wherein a coiled spring 71 is arranged between a piston rod 33 and a lever 17 to detect the amount of displacement of the piston rod 33 by means of a potentiometer 73. The amount of displacement of the piston rod 33 is proportional to the pressure difference between cylinder chambers, so that the detection of displacement of the piston rod 33 may permit the pressure difference and therefore steering torque of a steering wheel to be detected. The remaining part of the third embodiment may be constructed in substantially the same manner as the above-described first embodiment.

Figure 5:
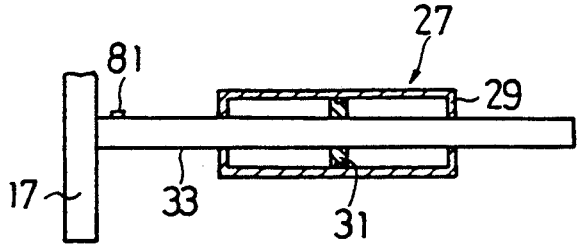
FIG. 5 is a fragmentary schematic sectional view showing a pressure difference detection means in a fourth embodiment of a power steering system for a boat according to the present invention.

FIG. 5 shows a fourth embodiment of a power steering system for a boat according to the present invention. A power steering system of the fourth embodiment is so constructed that strain of a piston rod 33 is detected by means of a strain sensor 81, to thereby detect a pressure difference between cylinder chambers and therefore steering torque of a steering wheel. The remaining part of the fourth embodiment may be constructed in substantially the same manner as the first embodiment.

The foregoing description of each of the embodiments has been made in connection with an engine comprising an outboard motor, however, the present invention may be of course applied to a boat driven by an inboard motor. Also, the present invention may be applied to various kinds of boats and ships.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A power steering system for a boat including an engine pivotally movably mounted on the boat, comprising:

a steering wheel mounted on the boat;

a lever connected to the engine;

a rack connected to said lever;

a pinion engaged with said rack;

a drive motor connected to said pinion;

a cylinder mechanism including a cylinder, a piston connected to said lever and slidably arranged in said cylinder, and at least one piston rod provided on said piston;

said cylinder mechanism being formed with a pair of chambers on both sides of said piston;

a pressure oil feed means for discharging pressure oil at a flow rate corresponding to the number of revolutions of said steering wheel;

a pair of hydraulic pipings arranged between said pressure oil feed means and said chambers of said cylinder mechanism formed on both sides of said piston;

a pressure difference detection means for detecting a difference in pressure between said chambers of said cylinder mechanism to generate a detection signal; and a controller for supplying a control signal to said drive motor depending upon said detection signal from said pressure difference detection means to cause said drive motor to generate assistance force corresponding to steering torque of said steering wheel.

2. A power steering system as defined in claim 1, wherein said pressure difference detection means directly detects a difference in pressure between said chambers of said cylinder mechanism.

3. A power steering system as defined in claim 1, wherein said pressure difference detection means detects the amount of displacement of said piston rod.

4. A power steering system as defined in claim 1, wherein said pressure difference detection means detects the amount of strain of said piston rod.

* * * * *